US007350782B2

(12) United States Patent
Sumner et al.

(10) Patent No.: US 7,350,782 B2
(45) Date of Patent: Apr. 1, 2008

(54) CHEERLEADER ACTION-FIGURE BOARD GAME

(76) Inventors: Wallace Maurice Sumner, 1697 Hillside St., Marietta, GA (US) 30066-4194; Peyton Emily Parker, 4015 Scarlet La., Kennesaw, GA (US) 30144

( * ) Notice: Subject to any disclaimer, the term of this patent is extended or adjusted under 35 U.S.C. 154(b) by 0 days.

(21) Appl. No.: 11/160,987

(22) Filed: Jul. 19, 2005

(65) Prior Publication Data

US 2007/0018390 A1 Jan. 25, 2007

(51) Int. Cl.
*A63F 3/00* (2006.01)

(52) U.S. Cl. ..... 273/243; 273/259; 273/277

(58) Field of Classification Search ..... 273/243, 273/244, 259, 277
See application file for complete search history.

(56) References Cited

U.S. PATENT DOCUMENTS

| | | | | | |
|---|---|---|---|---|---|
| 3,298,692 | A | | 1/1967 | Glass | 273/134 |
| 3,715,121 | A | * | 2/1973 | Renn | 273/405 |
| 3,735,986 | A | * | 5/1973 | Glass et al. | 273/249 |
| 3,997,162 | A | * | 12/1976 | Scullin | 273/348.3 |
| 4,118,035 | A | * | 10/1978 | Row | 273/243 |
| 4,211,408 | A | | 7/1980 | Tickle | 273/85 R |
| 4,241,924 | A | | 12/1980 | Arcara | 273/277 |
| 4,346,899 | A | | 8/1982 | Nuebling | 273/244 |
| 4,480,834 | A | * | 11/1984 | Minami | 273/317.3 |
| 4,553,757 | A | * | 11/1985 | Keeney | 273/369 |
| 4,783,080 | A | * | 11/1988 | Rosenwinkel et al. | 273/255 |
| 4,852,886 | A | * | 8/1989 | Zaruba et al. | 273/249 |
| 5,150,898 | A | | 9/1992 | Hochberg | 273/85 C |
| 5,603,504 | A | * | 2/1997 | Powell | 273/348.4 |
| 5,788,242 | A | | 8/1998 | Rudell | 273/317.3 |
| 2002/0043761 | A1 | * | 4/2002 | Brecheen et al. | 273/243 |
| 2004/0090010 | A1 | * | 5/2004 | Wilson | 273/317 |
| 2005/0062232 | A1 | * | 3/2005 | Pavlik et al. | 273/408 |

* cited by examiner

*Primary Examiner*—Vishu K. Mendiratta

(57) ABSTRACT

The present invention relates to an action-figure type board game wherein players advance their game pieces around a dividedly spaced instructional peripheral track in accordance with a die being thrown, subsequently allowing a player's poseable cheerleader figure to be launched and propelled gymnastically-like airborne at a plurality of athletic competition stations, and then land upright on landing surfaces using interlocking "hook and loop" fastener material, simulating the physical skills and tumbling routines that are performed by Competitive Cheerleaders, and in order to win, collect the majority plurality of awards referred to as "trophy" cards.

1 Claim, 13 Drawing Sheets

CHEERLEADER ACTION-FIGURE BOARD GAME

BACKGROUND OF THE INVENTION

The present invention generally relates to a board game and more specifically to an action-figure type board game wherein a plurality of game pieces are advanced around a peripheral track determined by throwing a die. As players advance their game pieces, the game will randomly instruct players to attempt challenging simulated athletic action events using poseable action figures culminating in the collection of awarded trophies.

Cheerleading, at one time only associated with those individuals that represented and supported their school's sporting teams and events, has recently evolved into its' own organized stand-alone athletic team sport known as Competitive Cheerleading. Over three million young members nationwide participate in the physical and mental conditioning, training and team-building aspects of the sport that are required in order to compete against one another. During competition these cheerleaders perform many timely choreographed team and individual gymnastic tumbling routines involving terminology such as base, full extension, flyer, balancing, toss, tumbler, target tumbling and standing back tuck, which are just a few examples. Usually trophies are awarded to the team and/or individual cheerleaders upon winning or placing in a competition.

Numerous action-figure type board games have been developed practically for all sports with the exception of Competitive Cheerleading. A need obviously exists for an action-figure type board game that would represent and especially appeal to those participants of all ages involved in the sport of Competitive Cheerleading. The present board game invention would also appeal to the young "wanna-be" cheerleaders as well as adults and the young in general.

BRIEF SUMMARY OF THE INVENTION

It is an object of the present invention to provide an action-figure type board game that excitingly simulates several of the physical skills and routines that are performed by Competitive Cheerleaders. Players will compete against one another by performing simulated tumbling routines using poseable cheerleader action-figures that are propelled gymnastically-like airborne from player operated launching devices. The game may be played by two or more individual players or by players forming teams. A playing board surface will support the components of the game, and will allow players to advance game pieces around a dividedly spaced instructional peripheral track in accordance with a die being thrown. As players advance their game pieces around the track, players will follow the instructions provided by each space that they land upon. Occasionally a player's game piece may come to rest upon one of several randomly located track spaces that direct that player to draw an instructional card which provides further instructions for that player to follow.

The goal of playing the present board game invention is for individual or team players to advance their game pieces around the track, compete by progressively attempting tumbling routines at "competition stations", and in order to win, collect the majority plurality of "trophy" cards which are awarded for each successfully performed tumbling routine. Additionally a player will receive a trophy card for each complete trip around the track, and whenever a space or an instructional card so provides. Players will be limited to two attempts in order to perform one successful routine.

It is also an object of the present invention to provide a board game utilizing a plurality of poseable cheerleader action-figures that are each capable of being posed and positioned life-like, and then launched and propelled gymnastically-like airborne, simulating tumbling routines referred to as "standing back-tucks", "target tumbling" and "tosses", from player operated launching devices, which propel cheerleader action-figures, simulating "flyers" and "tumblers", toward and onto trophy award landing mats that are located on the playing board surface.

It is also an object of the present invention to provide a board game utilizing said cheerleader action-figures that are also each capable of being balanced, simulating a "flyer", atop a non-poseable cheerleader action-figure that is simulating a "base". In the execution of this routine, referred to as a "full extension", a heavy rolling ball will attempt to disturb the base's and/or the flyer's balance causing the flyer to fall undesirably, which in this case no trophy card is awarded.

Additionally, it is an object of the present board game invention to provide a plurality of said cheerleader action-figures wherein the "shoes" of each said figure are attached to a top surface of a weighted base plate. Said base plate will have an underside surface of hook-type fastener material, such as the hook material found in "Velcro Hook and Loop", in order that airborne said cheerleader figures will have the capability of successfully landing upright atop trophy award landing mats that have a top surface of corresponding loop-type fastener material, such as the loop material found in "Velcro Hook and Loop". Said hook material will connectively interlock with said loop material upon contact with one another allowing said cheerleader figure to desirably remain upright and allow players to receive an awarded trophy card.

It is also a more detailed object of the present invention to provide a cheerleader action-figure type board game with a playing board surface comprising four competition stations referred to as:

Station 1 Base and Flyer Full Extension Balancing Competition

Station 2 Standing Back-Tuck Competition

Station 3 Target Tumbling Competition

Station 4 Target Toss Competition

Said stations are preassembled and attached to the playing board surface prior to the start of the game. Said stations are attached to the playing board surface in order to provide stability. Dowel pins or the like may be used to fit into suitable holes on the playing board surface as those skilled in the art are quite knowledgeable.

It is also an object of the present invention to provide a cheerleader action-figure type board game also comprising landing "props" having a top surface of said loop-type fastener material. Any player having fortune to successfully land and remain upright, may be awarded multiple trophy cards or even win the game depending on which landing prop was instructed to be used. Said landing props are of different structural shapes and colors with each offering its' own degree of difficulty and are suggestively referred to as: Blue Rectangular Landing Prop; Yellow Cylindrical Landing Prop; Red Rockable Landing Prop; and Green Slanted Landing Prop.

Additionally, it is an object of the present board game invention that three different types of launch device assemblies be used. Two of the three launch devices will be of the lever and fulcrum type operation, one being stationary and the other player moveable. The remaining launch device will be player movable and of the spring-board type operation, with all three being further detailed and described within this specification.

The aforementioned clearly reflects the novelty and uniqueness of the present invention over the prior art.

DETAILED DESCRIPTION OF THE INVENTION

Figure 1:
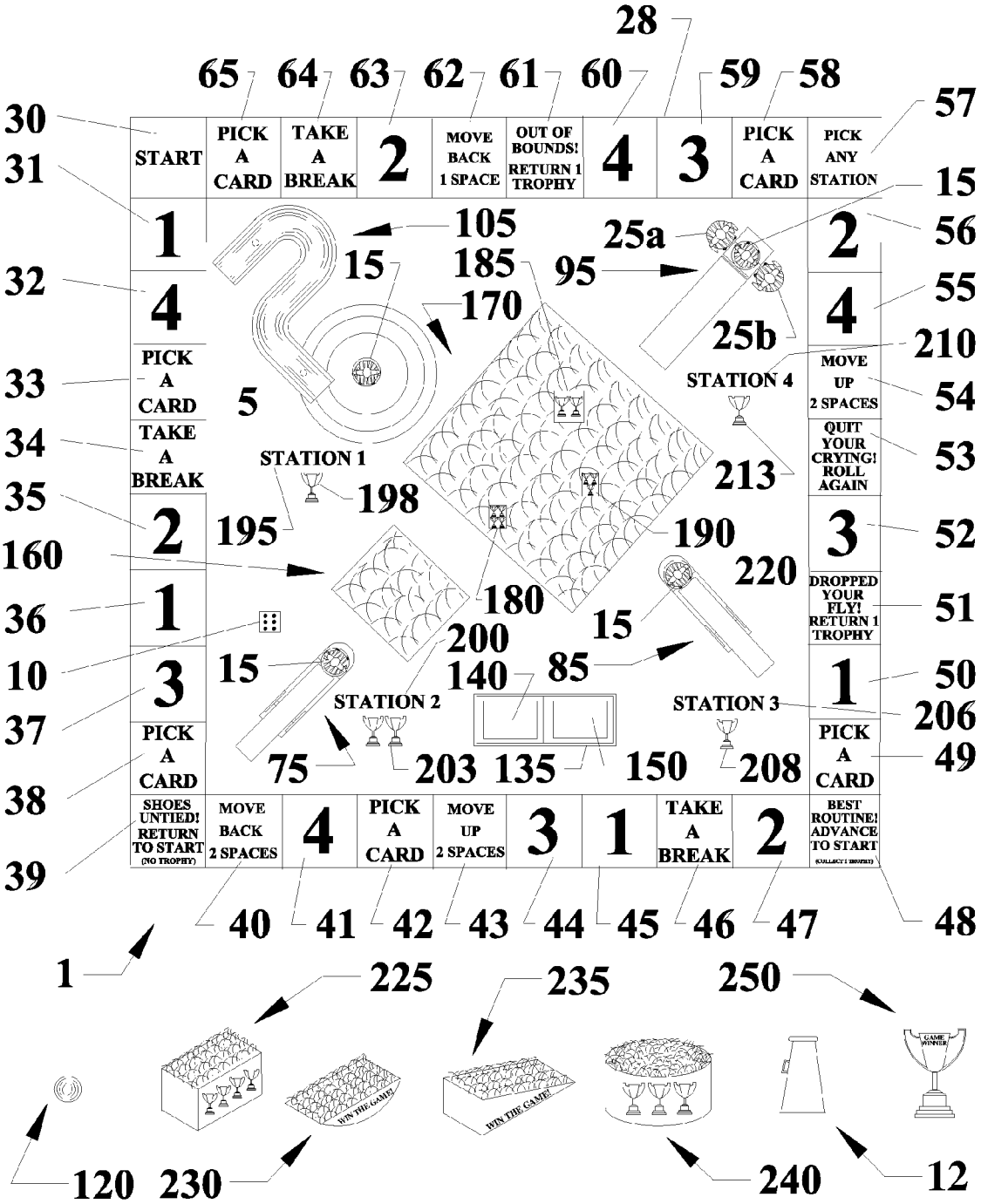
FIG. 1 is a plan view of the board game depicting the game playing surface and the game components.
Figure 16:
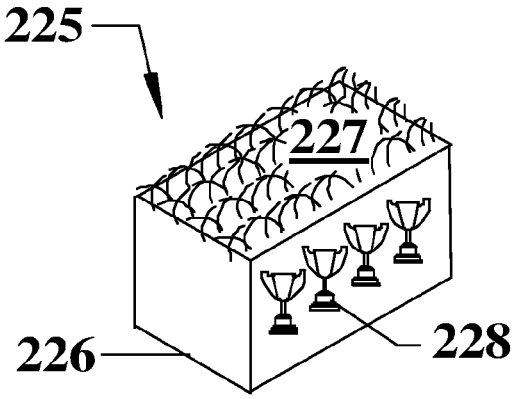
FIG. 16 is a perspective view depicting the Rectangular Landing Prop.
Figure 15:
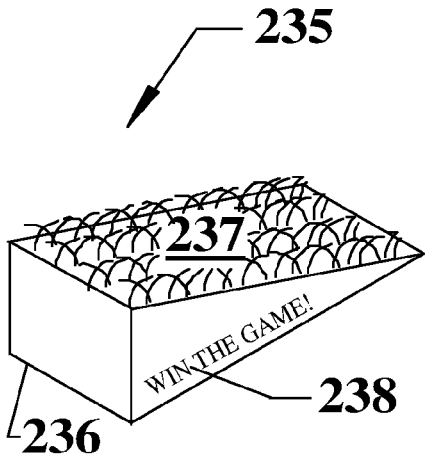
FIG. 15 is a perspective view depicting the Slanted Landing Prop.

Drawing Reference Character Legend:

1 cheerleader game
5 game baseboard
10 die
12 game piece
14 "knees bent" poseable cheerleader figure
15 poseable cheerleader figure
16 figure base plate
17 base plate hook-type fastener material
18 base contact point
20 Station 1 base cheerleader figure
21*a* figure base plate
21*b* figure base plate
22 flyer support plate
25*a* Station 4 base cheerleader figure
25*b* Station 4 base cheerleader figure
26*a* figure base plate
26*b* figure base plate
27*a* figure's elbow/arm/hand
27*b* figure's elbow/arm/hand
28 game track
30 "START" space
31 Station "1" space
32 Station "4" space
33 "PICK A CARD" space
34 "TAKE A BREAK" space
35 Station "2" space
36 Station "1" space
37 Station "3" space
38 "PICK A CARD" space
39 "SHOES UNTIED! RETURN TO START (NO TROPHY)" space
40 "MOVE BACK 2 SPACES" space
41 Station "4" space
42 "PICK A CARD" space
43 "MOVE UP 2 SPACES" space
44 Station "3" space
45 Station "1" space
46 "TAKE A BREAK" space
47 Station "2" space
48 "BEST ROUTINE! ADVANCE TO START (COLLECT 1 TROPHY)" space
49 "PICK A CARD" space
50 Station "1" space
51 "DROPPED YOUR FLY! RETURN 1 TROPHY" space
52 Station "3" space
53 "QUIT YOUR CRYING! ROLL AGAIN" space
54 "MOVE UP 2 SPACES" space
55 Station "4" space

56 Station "2" space
57 "PICK ANY STATION" space
58 "PICK A CARD" space
59 Station "3" space
60 Station "4" space
61 "OUT OF BOUNDS! RETURN 1 TROPHY" space
62 "MOVE BACK 1 SPACE" space
63 Station "2" space
64 "TAKE A BREAK" space
65 "PICK A CARD" space
75 Station 2: "Standing Back-Tuck Competition" launch device
76 launch lever
77 fulcrum
78*a* fulcrum support member
78*b* fulcrum support member
79 launch device base
80 launch platform
81 fulcrumed lever portion
82 finger force portion
83 launch force contact portion
85 Station 3: "Target Tumbling Competition" launch device
86 launch lever
87 fulcrum
88*a* fulcrum support member
88*b* fulcrum support member
89 launch device base
90 launch platform
91 base pivot dowel
92 fulcrumed lever portion
93 finger force portion
94 launch force contact portion
95 Station 4: "Target Toss Competition" launch device
96 launch device base
97 spring-board
98*a* spring-board support member
98*b* spring-board support member
99 launch platform
100 finger force portion
101 limit stop
102 flex portion
103 base pivot dowel
105 Station 1: "Base and Flyer Full Extension Balancing Competition" assembly
106 meandering gutter
107 gutter high support leg
108 gutter low support leg
115 balance platform
120 roll ball
121 roll ball starting position
122 rolling ball
125 revolving ball
135 two-deck game card holder
136 peripheral wall
137 divisional wall
138 bottom support
140 instructional cards
141 printed instruction
150 trophy cards
151 trophy icon
160 Station 2 landing mat
161 mat base
162 mat loop-type fastener material
170 Stations 3 and 4 landing mat
171 mat base
172 mat loop-type fastener material
180 4 trophies award target icon
185 2 trophies award target icon
190 3 trophies award target icon
195 "Station 1" label
198 1 trophy award icon
200 "Station 2" label
203 2 trophies award icon
206 "Station 3" label
208 1 trophy award icon
210 "Station 4" label
213 1 trophy award icon
220 top surface area
225 rectangular landing prop
226 blue colored rectangular landing base
227 base loop-type fastener material
228 4 trophies award icon
230 rockable landing prop
231 red colored rockably-shaped landing base
232 base loop-type fastener material
233 "Win The Game" icon
235 slanted landing prop
236 green colored slanted landing base
237 base loop-type fastener material
238 "Win The Game" icon
240 cylindrical landing prop
241 yellow colored cylindrical landing base
242 base loop-type fastener material
243 3 trophies award icon
250 game winner trophy
251 "Game Winner" trophy label The present board game invention will use a deck of 28 shuffled printed instructional cards per the following legend which describes each card's label and its' in the deck:

CARD LABEL DESCRIPTION LEGEND

| CARD LABEL | QUANTITY |
|---|---|
| "CHALLENGE ANY COMPETITOR TO STATION 1" | 2 |
| "CHALLENGE ANY COMPETITOR TO STATION 2" | 2 |
| "CHALLENGE ANY COMPETITOR TO STATION 3" | 2 |
| "CHALLENGE ANY COMPETITOR TO STATION 4" | 2 |
| "FREE ROLL!" | 3 |
| "PERFECT ROUTINE! TAKE 1 TROPHY FROM EACH COMPETITOR" | 1 |
| "COACH NOT LOOKING! GO TO STATION 4" | 2 |
| "GREAT CONCENTRATION! TRY ANY EVENT" | 2 |
| "MOM IS WATCHING! GO TO 4" | 1 |
| "TAKE 1 TROPHY FROM EACH COMPETITOR" | 1 |
| "QUIT SHOWING OFF! GO BACK TO START (NO TROPHY)" | 2 |
| "MISSED PRACTICE! RETURN 2 TROPHIES" | 1 |
| "SORRY! NOT CONCENTRATING GO BACK TO START" | 1 |
| "WOW! YOU ARE GOOD! TRY YELLOW ANYWHERE" | 2 |
| "SHOW OFF! TRY BLUE ANYWHERE" | 2 |
| "YOUR BIG CHANCE! WIN THE GAME WITH RED AT STATION 3" | 1 |
| "LET'S SEE WHAT YOU CAN REALLY DO! WIN THE GAME WITH GREEN AT STATION 4" | 1 |

In general the game board is set up for play by attaching all four preassembled competition stations to the game baseboard, by attaching both landing mats to said baseboard, by placing the cards holder containing all cards on or near said baseboard, by placing the four landing props on or near said baseboard, by placing Station 1 base cheerleader near said baseboard and by placing the sought-after "Game Winner" trophy in view of all players. The game begins by shuffling the instructional cards and each player selecting a colored game piece and corresponding matching colored poseable cheerleader action-figure. Each player shall roll the die with the player having rolled the highest number starting first, and with the remaining players taking their turns in a clockwise rotation from the first player's left. If players combine to form teams in lieu of individual play, team members shall alternate in their turn taking. Players shall be awarded trophy cards from a deck upon successfully performing routines. Once the deck of trophy cards has been exhausted, the player or team with the majority of trophy cards wins the game and the "Game Winner" trophy. In the event of a tie game, those tied players shall roll the die for a game tie-breaker. The player or team member with the highest number rolled may challenge the player or team member with the second highest number rolled, to a playoff tie-breaker routine at any competition station that the challenger selects.

FIG. 1 shows the cheerleader game 1 with all of the game components. Game 1 is played on a playing surface referred to as game baseboard 5. In a preferred embodiment said baseboard may be rotated from player to player by mounting said baseboard atop a rotateable means such as a "Lazy-Susan" type device. Baseboard 5 comprises a dividedly spaced instructional peripheral game track 28, a Station 1: "Base and Flyer Full Extension Balancing Competition" assembly 105, a Station 2: "Standing Back-Tuck Competition" launch device 75, a Station 3: "Target Tumbling Competition" launch device 85, a Station 4: "Target Toss Competition" launch device 95, a Station 2 landing mat 160, a Stations 3 and 4 landing mat 170, a two deck game card holder 135, a die 10, a plurality of player game piece 12, a rectangular landing prop 225, a rockable landing prop 230, a slanted landing prop 235, a cylindrical landing prop 240, a roll ball 120, a plurality of poseable cheerleader FIG. 15, Station 3 stationary base cheerleader FIGS. 25*a* and 25*b*, a game winner trophy 250 and a top surface area 220 that is available for various suitable cheerleading symbology, images, advertising, etc.

Game track 28 as shown in FIG. 1 comprises labeled instructional spaces 30 through 65 which are each descriptively identified in the Drawing Reference Character Legend in this specification. Stations 105, 75, 85, and 95 are identified by label upon baseboard 5 as "Station 1" label 195, "Station 2" label 200, "Station 3" label 206 and "Station 4" label 210 respectively. Below each said label are icons of trophies identifying the quantity of trophies that are awarded for a successful routine at said Stations and are referred to as 1 trophy award icon 198, 2 trophies award icon 203, 1 trophy award icon 208 and 1 trophy award icon 213. Stations 3 and 4 landing mat 170 offers optional awarded trophies whenever a player's cheerleader FIG. 15 successfully lands upon a trophy award target icon referred to as 4 trophies award target icon 180, 3 trophies award target icon 190 and 2 trophies award target icon 185. A card holder 135 will maintain game instructional cards 140 and game trophy cards 150. Each player's roll of die 10 will indicate the number of spaces that a player may advance his or her game piece 12.

Figure 2:
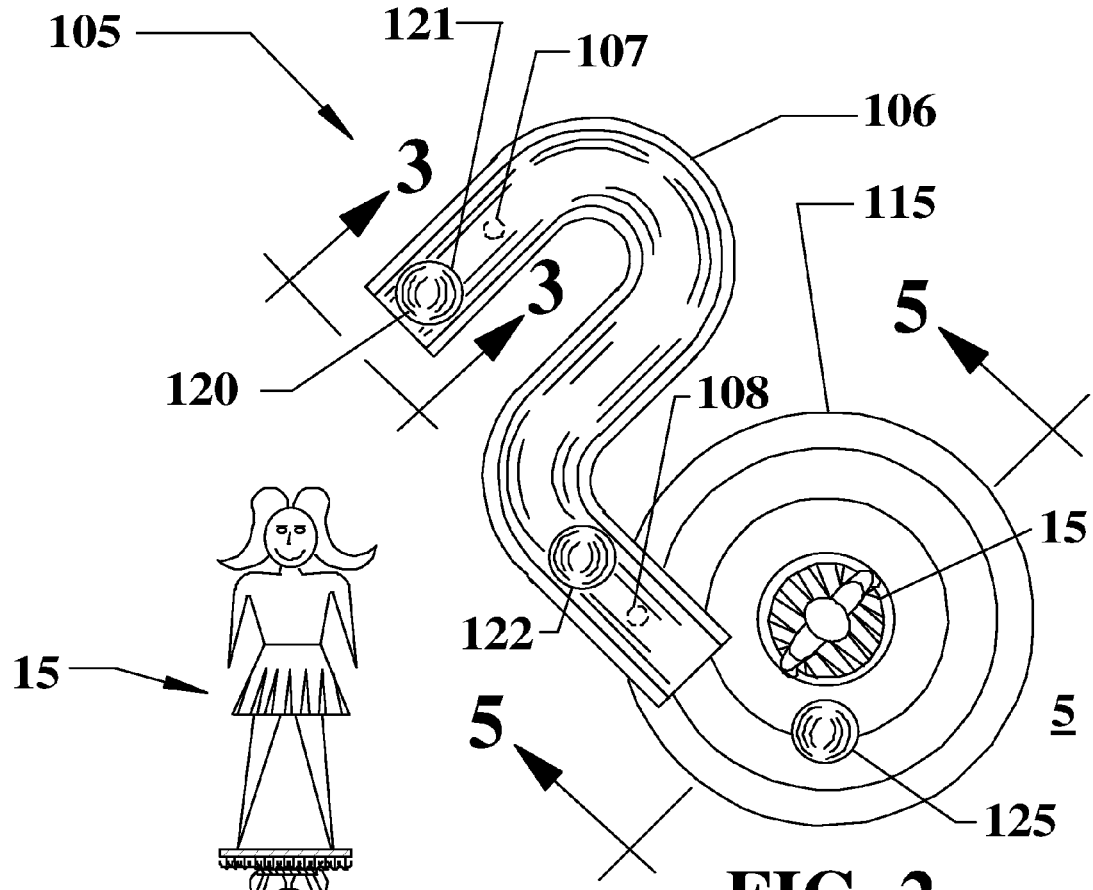
FIG. 2 is a plan view depicting Station 1.
Figure 5:
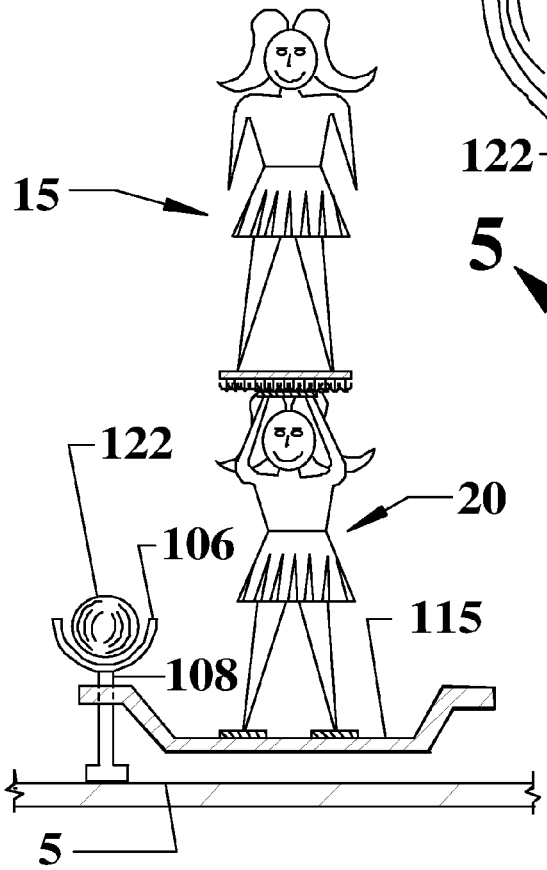
FIG. 5 is a sectional view of FIG. 2 depicting Station 1 with a cheerleader action-figure performing as a "flyer" balanced atop a cheerleader base action-figure.
Figure 3:
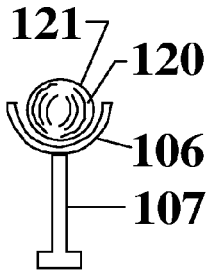
FIG. 3 is a sectional view of FIG. 2 depicting components roll ball, meandering gutter and gutter high support leg.
Figure 4:
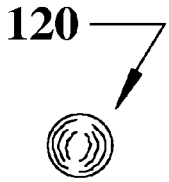
FIG. 4 is an elevation view depicting component roll ball.
Figure 20:
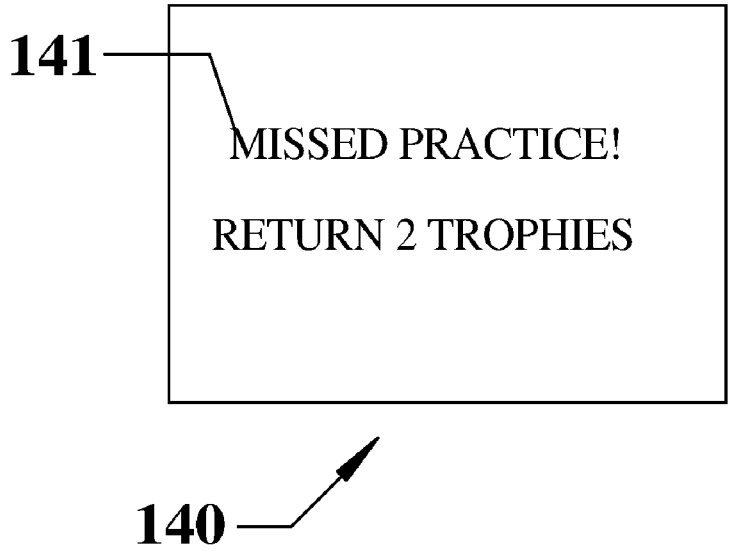
FIG. 20 is a plan view depicting a game instructional card.

FIGS. 2, 3, 4 and 5 show Station 1 assembly 105 and its' components as well as a poseable cheerleader FIG. 15 and a non-poseable base cheerleader FIG. 20. Plan view FIG. 2 shows a roll ball 120 player-placed in a starting position 121 of a meandering gutter 106. Gutter 106 is supportively sloped gently downward toward and above base cheerleader figure balance platform 115 using an attached gutter high support leg 107 and an attached gutter low support leg 108. Said support legs may incorporate dowel pins or the like in order to attach and stabilize gutter 106 to baseboard 5 as those skilled in the art are quite knowledgeable. Roll ball 120 is player-released and becomes a rolling ball 122 as said ball meanders down gutter 106. Said ball gathers momentum and falls by gravity onto a balance platform 115. Platform 115 will be saucer-shaped or the like in order to retain and induce circular revolution of rolling ball 122 allowing said ball to become a revolving ball 125. As shown in sectional view FIG. 5 platform 115 is cantilevered and supportively attached to low support leg 108 essentially suspending said platform unsteadily above baseboard 5. Base cheerleader FIG. 20 is player-placed atop platform 115 followed by cheerleader FIG. 15 being player-placed delicately balanced atop FIG. 20. FIG. 4 shows the game roll ball 120. Sectional view FIG. 3 shows roll ball starting position 121 in gutter 106 with said gutter supported by leg 107. Once a player has been instructed to perform at Station 1, said player will strategically place FIG. 20 atop platform 115, pose and balance his or her FIG. 15 atop FIG. 20, place and release roll ball 120 in gutter 106, allow rolling ball 122 to fall onto said platform and to become revolving ball 125, allow the forces created by falling rolling ball 122 and revolving ball 125 to shake said platform and said cheerleader figures, and allow ball 125 to ultimately come to a resting position. The player shall be permitted two attempts for his or her FIG. 15 to successfully remain atop FIG. 20 without falling in order to be awarded one trophy card 150.

Figure 7:
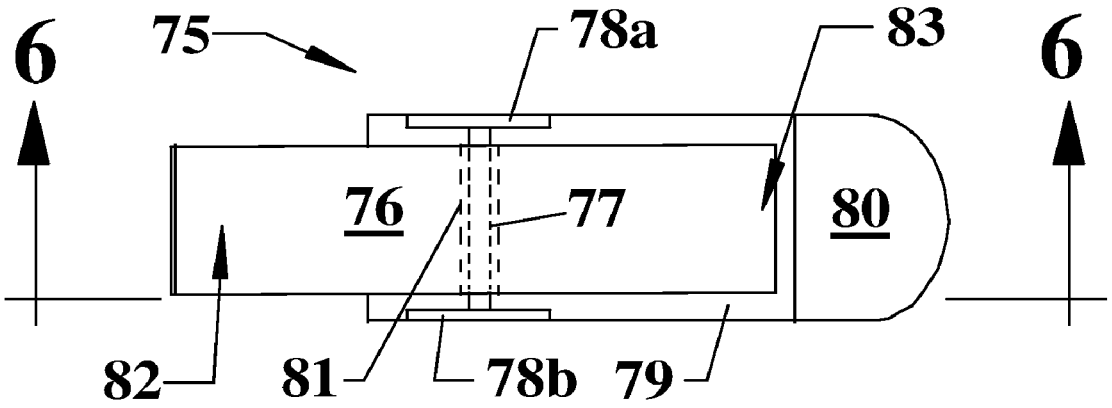
FIG. 7 is a plan view depicting Station 2 launch device (cheerleader action-figure not shown for clarity).
Figure 6:
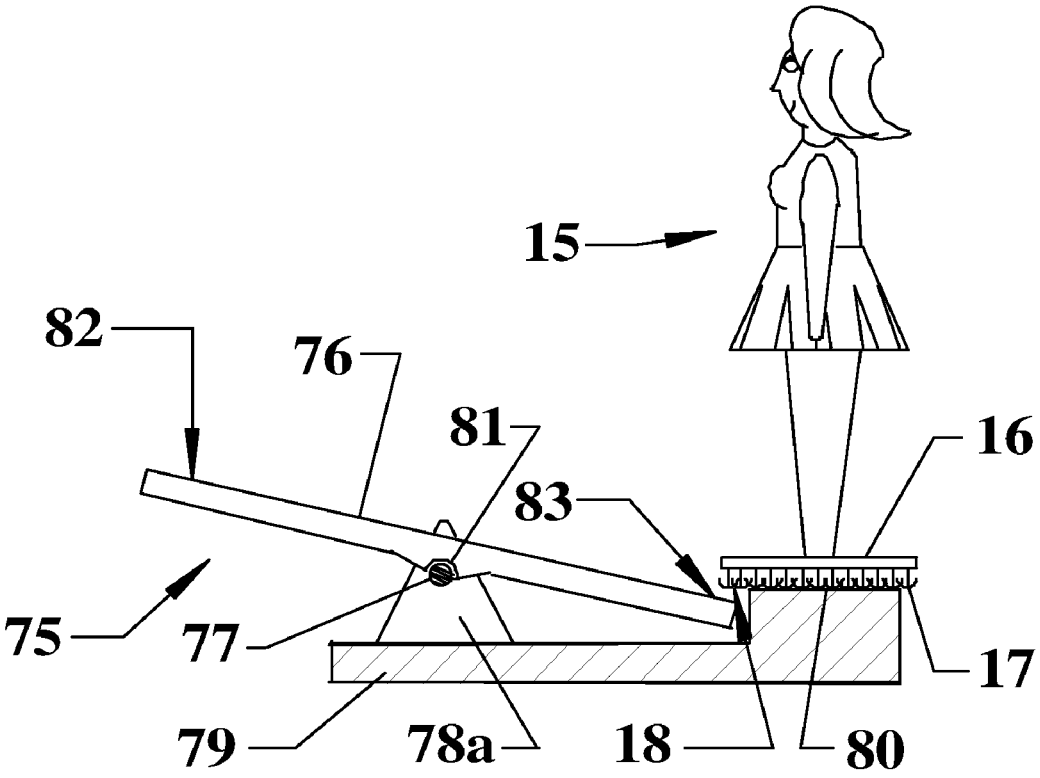
FIG. 6 is a sectional view of FIG. 7 depicting Station 2 launch device with a cheerleader action-figure in launching position.

Sectional view FIG. 6 and plan view FIG. 7 show a stationary lever and fulcrum operated Station 2: "Standing Back-Tuck Competition" launch device 75. Launch device 75 comprises a launch lever 76, a fulcrum 77, fulcrum support members 78*a* and 78*b*, a launch device base 79, a launch platform 80, a fulcrumed lever portion 81, a finger force portion 82 and a launch force contact portion 83. Base 79 may incorporate dowel pins or the like in order to attach and stabilize launch device 75 to baseboard 5 as those skilled in the art are quite knowledgeable.

FIG. 6 shows a cheerleader FIG. 15 that has been posed and strategically positioned atop launch platform 80. By a player skillfully pressing portion 82 with the appropriate downward finger force, the opposing fulcrumed upward launching force at portion 83 comes in contact with an above located cheerleader base contact portion 18 resulting in FIG. 15 being launched and propelled gymnastically-like airborne toward and onto a landing mat 160 (not shown here), thus simulating a cheerleader "Standing Back-Tuck" tumbling routine. A player shall be awarded two of trophy card 150 for successfully landing and remaining upright on landing mat 160, provided that no portion of said 15 comes in any physical contact with the top surface of baseboard 5. A player shall be limited to two attempts at Station 2 in order for his or her FIG. 15 to successfully land and remain upright.

Figure 9:
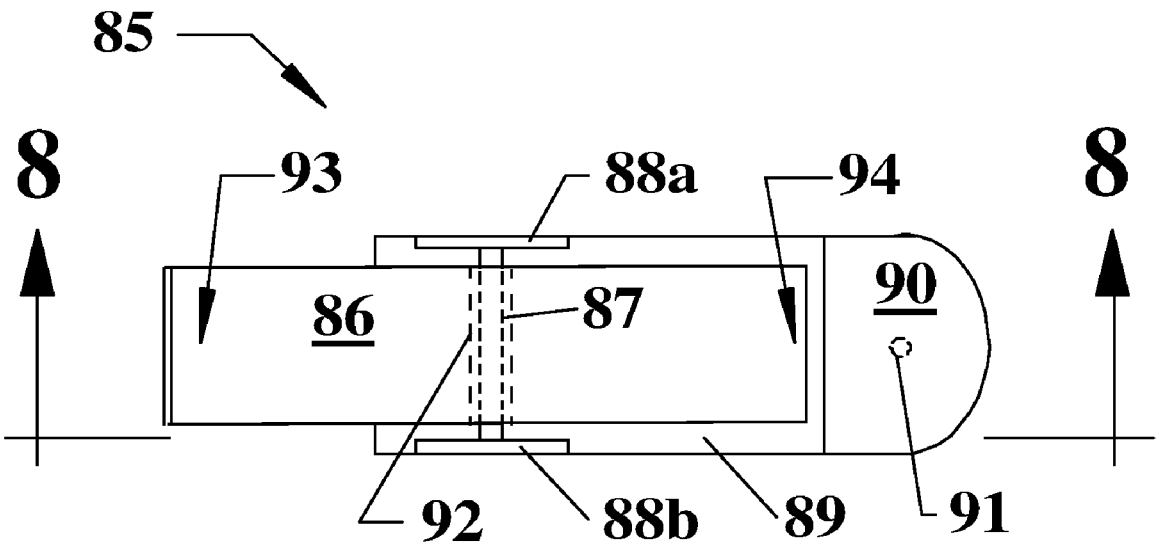
FIG. 9 is a plan view depicting Station 3 launch device (cheerleader action-figure not shown for clarity).
Figure 8:
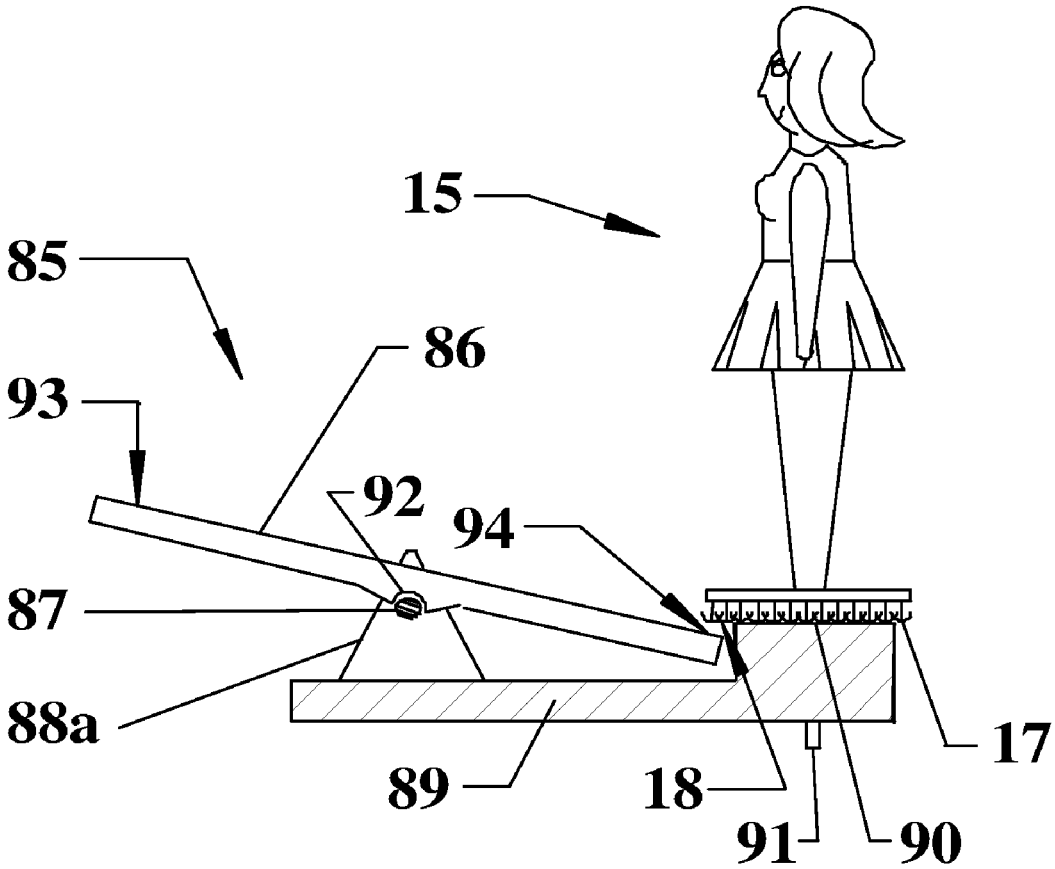
FIG. 8 is a sectional view of FIG. 9 depicting Station 3 launch device with a cheerleader action-figure in launching position.

Sectional view FIG. 8 and plan view FIG. 9 show a player-movable lever and fulcrum operated Station 3: "Target Tumbling Competition" launch device 85. Launch device 85 comprises a launch lever 86, a fulcrum 87, fulcrum support members 88*a* and 88*b*, a launch device base 89, a launch platform 90, a base pivot dowel 91, a fulcrumed lever portion 92, a finger force portion 93 and a launch force contact portion 94. Base pivot dowel 91 may be used to attach and stabilize launch device 85 to baseboard 5 as those skilled in the art are quite knowledgeable, but shall also permit base 89 and therefore launch device 85 to be player-movable and player-aimable by said base slideably pivoting about dowel 91.

FIG. 8 shows a cheerleader FIG. 15 that has been posed and strategically positioned atop launch platform 90 . By a player skillfully moving and aiming launch device 85, and skillfully pressing portion 93 with the appropriate downward finger force, the opposing fulcrumed upward launching force at portion 94 comes in contact with an above located cheerleader base contact portion 18 resulting in FIG. 15 being launched and propelled gymnastically-like airborne toward a landing mat 170 (not shown here) and desirably onto trophy award target icons located atop said mat, thus simulating a cheerleader "Target Tumbling" routine. A player shall be awarded the corresponding plurality of trophy card 150 for successfully landing and remaining upright on said target icons provided that any portion of FIG. 15 comes in physical contact with said target icons. If a player's FIG. 15 does not land on a said target icon but lands elsewhere on said mat, that player shall be awarded one trophy card 150 for successfully landing and remaining upright on mat 170, provided that no portion of said 15 comes in any physical contact with the top surface of base board 5. A player shall be limited to two attempts at Station 3 in order for his or her FIG. 15 to successfully land and remain upright.

Figure 11:
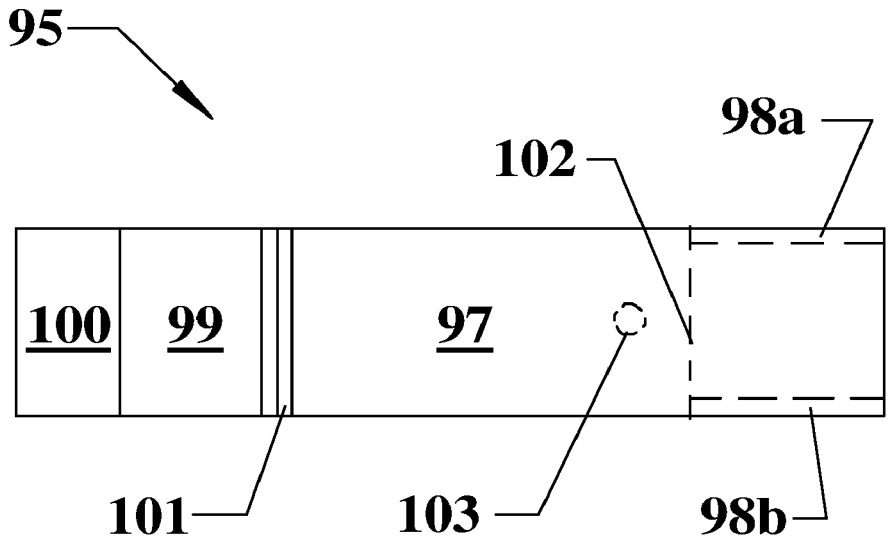
FIG. 11 is a plan view depicting Station 4 launch device (cheerleader action-figure not shown for clarity).
Figure 10:
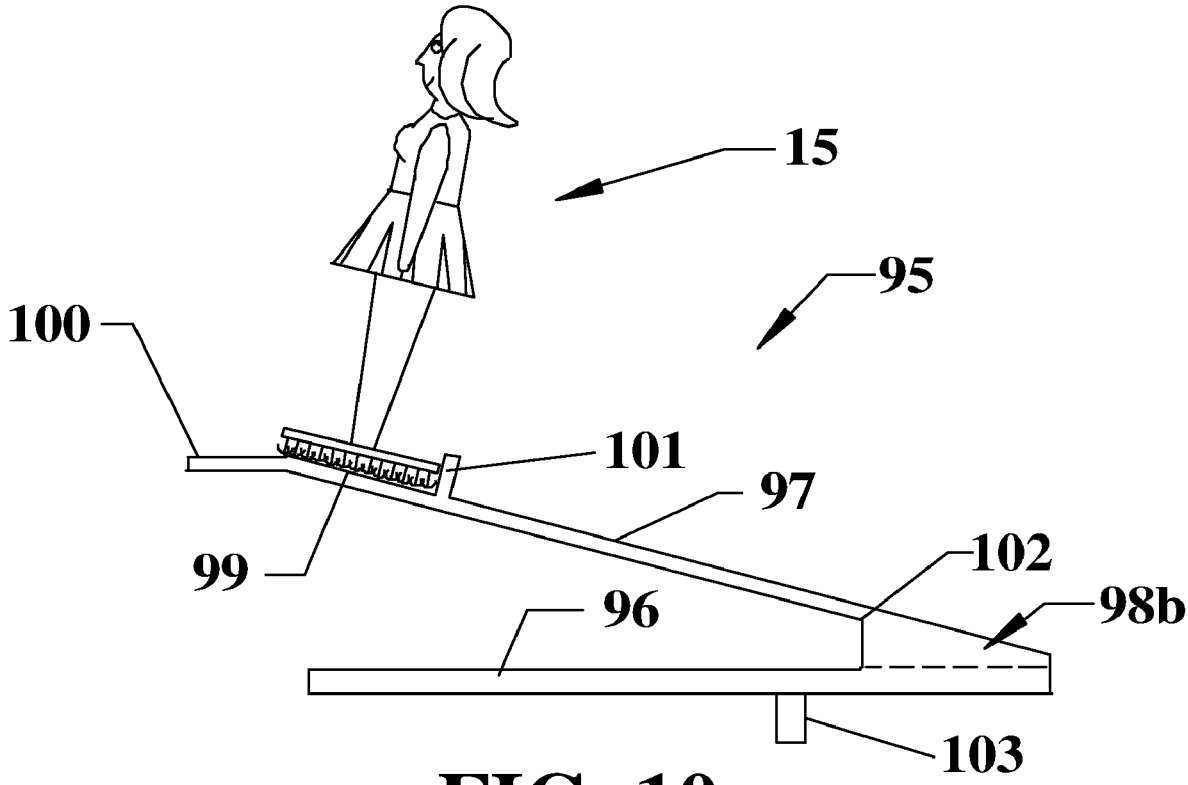
FIG. 10 is an elevation view depicting Station 4 launch device with a cheerleader action-figure in launching position.

Elevation FIG. 10 and plan view FIG. 11 show a player-movable spring-board operated Station 4: "Target Toss Competition" launch device 95. Launch device 95 comprises a launch device base 96, a spring-board 97, spring-board support members 98*a* and 98*b*, a launch platform 99, a figure force portion 100, a platform limit stop 101, a spring-board flex portion 102 and a base pivot dowel 103. Base pivot dowel 103 may be used to attach and stabilize launch device 95 to baseboard 5 as those skilled in the art are quite knowledgeable, but shall also permit base 96 and therefore launch device 95 to be player-movable and player-aimable by said base slideably pivoting about dowel 103.

FIG. 10 shows a player's cheerleader FIG. 15 that has been posed and strategically positioned atop launch platform 99. By said player skillfully moving and aiming launch device 95, and by said player skillfully pressing portion 100 with the appropriate downward finger force and then releasing portion 100, spring-board 97 flexes at flex portion 102 causing spring-board 97 to become biased to return to its' original position. Said returning spring-board 97 provides an upward launching force at launch platform 99 which causes FIG. 15 to be launched and propelled gymnastically-like airborne toward a landing mat 170 (not shown here) and desirably onto trophy award target icons located atop said mat, thus simulating a cheerleader "Target Toss" tumbling routine. A player shall be awarded the corresponding plurality of trophy card 150 for successfully landing and remaining upright on said target icons provided that any portion of FIG. 15 comes in physical contact with said target icons. If a player's FIG. 15 does not land on a said target icon but lands elsewhere on said mat, that player shall be awarded one trophy card 150 for successfully landing and remaining upright on mat 170, provided that no portion of said 15 comes in any physical contact with the top surface of base board 5. A player shall be limited to two attempts at Station 4 in order for his or her FIG. 15 to successfully land and remain upright.

Figure 12:
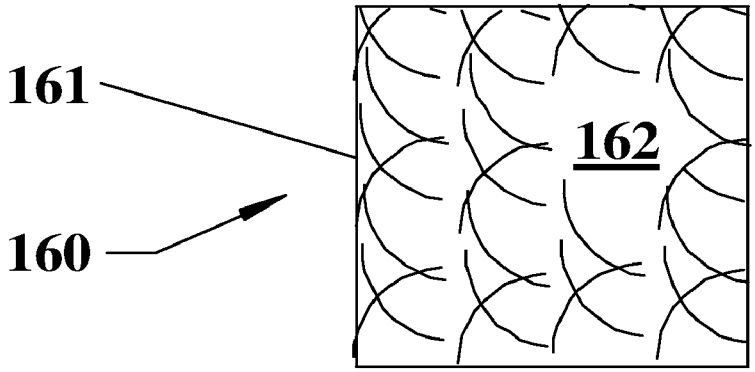
FIG. 12 is a plan view depicting Station 2 landing mat.

Plan view FIG. 12 shows Station 2 landing mat 160. Mat 160 comprises a mat base 161 and a top surface of loop-type fastener material 162, such as the loop material found in "Velcro Hook and Loop". Mat base 161 may incorporate dowel pins or the like in order to attach said mat to baseboard 5 as those skilled in the art are quite knowledgeable.

Figure 13:
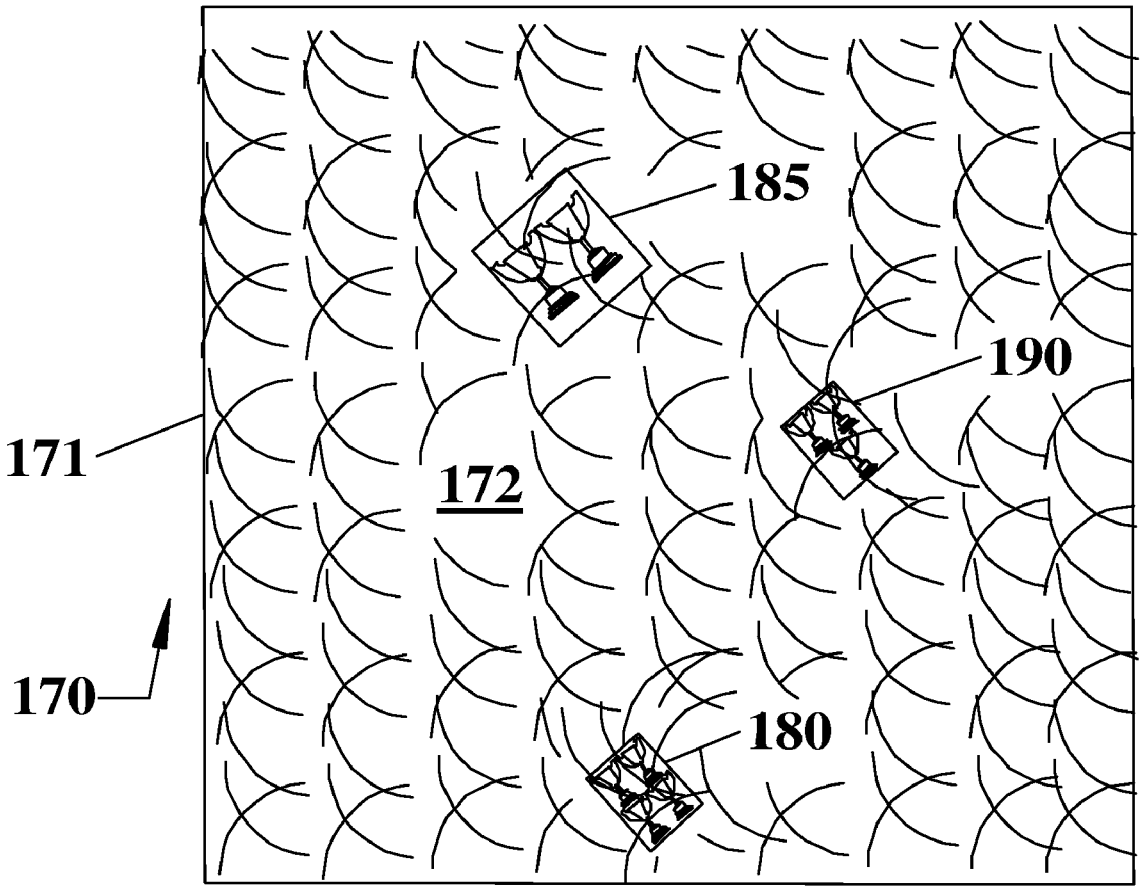
FIG. 13 is a plan view depicting Stations 3 and 4 landing mat.

Plan view FIG. 13 shows Stations 3 and 4 landing mat 170. Mat 170 comprises a mat base 171, a top surface of loop-type fastener material 172 such as the loop material found in "Velcro Hook and Loop", 4 trophies award target icon 180, 3 trophies award target icon 190 and 2 trophies award target icon 185. Said target icons may be color printed or the like onto material 172 but shall also have a top surface of said loop material. Mat base 171 may incorporate dowel pins or the like in order to attach mat 170 to base board 5 as those skilled in the art are quite knowledgeable.

Figure 14:
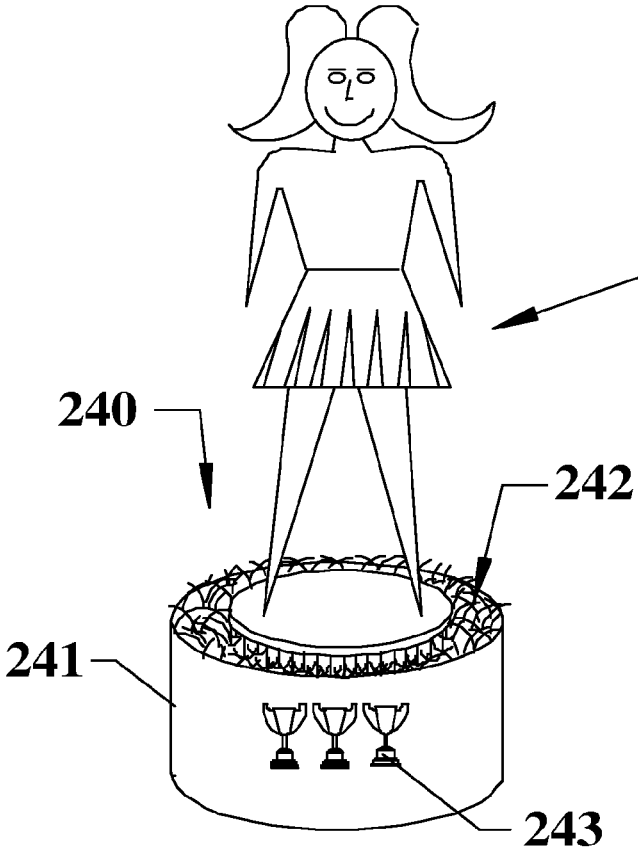
FIG. 14 is a perspective view depicting the Cylindrical Landing Prop with a successfully landed cheerleading action-figure atop.

Perspective view FIG. 14 shows a FIG. 15 that has successfully landed atop cylindrical landing prop 240. Prop 240 comprises a yellow colored cylindrical landing base 241, a top surface of loop-type fastener material 242, such as the loop material found in "Velcro Hook and Loop" and 3 trophies award icon 243. Icon 243 is visibly located on base 241.

Perspective view FIG. 15 shows slanted landing prop 235. Prop 235 comprises a green colored slanted landing base 236, a top surface of loop-type fastener material 237, such as the loop material found in "Velcro Hook and Loop" and a "Win The Game" label 238. Label 238 is visibly located on base 236.

Perspective view FIG. 16 shows rectangular landing prop 225. Prop 225 comprises a blue colored rectangular landing base 226, a top surface of loop-type fastener material 227, such as the loop material found in "Velcro Hook and Loop" and 4 trophies award icon 228. Icon 228 is visibly located on base 226.

Figure 17:
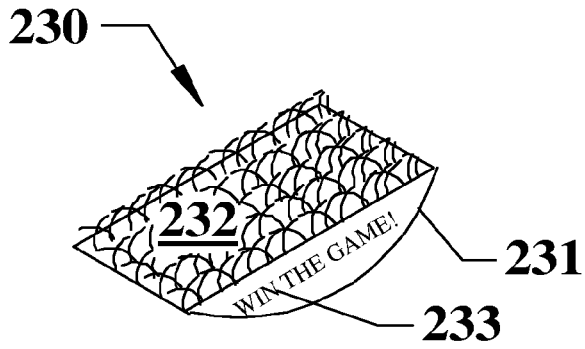
FIG. 17 is a perspective view depicting the Rockable Landing Prop.

Perspective view FIG. 17 shows rockable landing prop 230. Prop 230 comprises a red colored rockably-shaped landing base 231, a top surface of loop-type fastener material 232, such as the loop material found in "Velcro Hook and Loop" and a "Win The Game" label 233. Label 233 is visibly located on base 231.

Whenever the game instructs a player to use a landing prop 240, 235, 225 or 230 at either landing mat 160 or 170, the player shall position said prop anywhere upon said mat location as desired.

Figure 18:
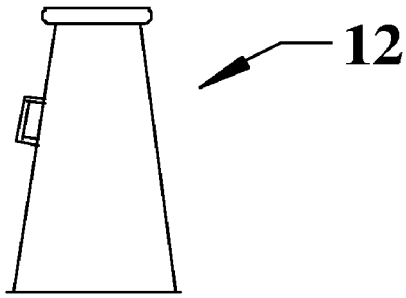
FIG. 18 is an elevation view depicting a player game piece.

FIG. 18 shows one of a plurality of different colored megaphone-shaped player game pieces 12 that will be selected and used by players to advance about track 28. There will be a matching colored game piece 12 for each corresponding colored cheerleader FIG. 15.

Figure 19:
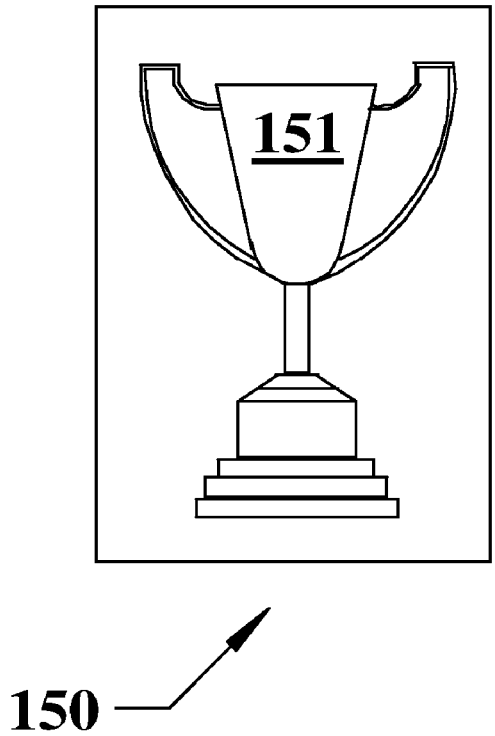
FIG. 19 is a plan view depicting a game trophy card.

FIG. 19 shows one of a plurality of game trophy cards 150 comprising a trophy icon 151. It is suggested that there be 12 of cards 150 per each player allocated to the card deck prior to the start of a game.

FIG. 20 shows one of a suggested total 28 of game instructional cards 140 comprising a printed instruction 141. Printed instruction descriptions for each said card and their quantity in said deck appear in a Card Label Description Legend provided in this specification.

Figure 21:
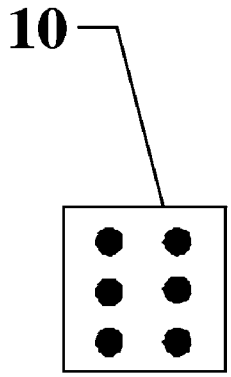
FIG. 21 is a plan view depicting the game die.

FIG. 21 shows a standard die 10.

Figure 25:
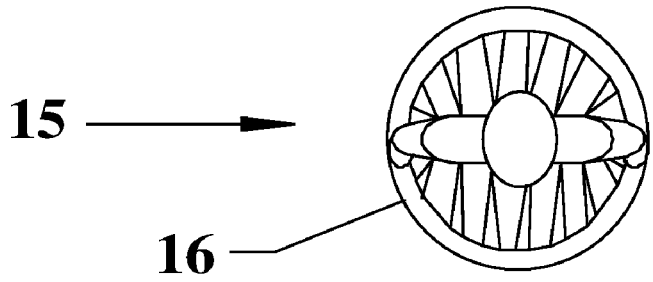
FIG. 25 is a plan view depicting a cheerleader action-figure.
Figure 22:
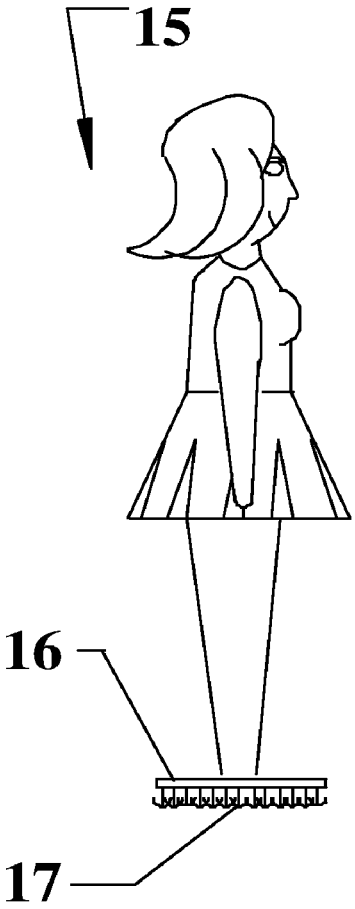
FIG. 22 is an elevation view depicting a cheerleader action-figure assembly.
Figure 23:
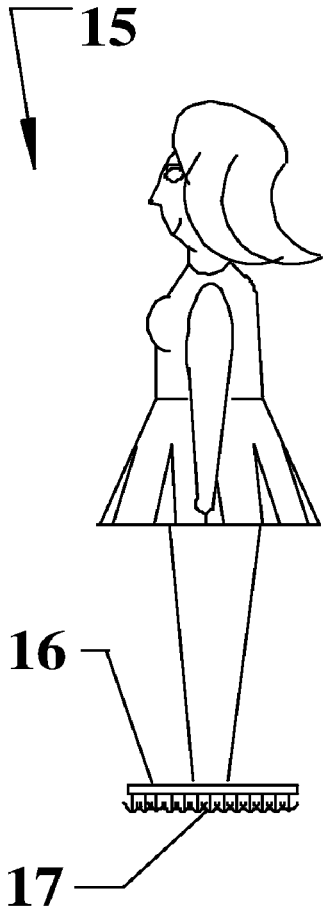
FIG. 23 is an elevation view depicting a cheerleader action-figure assembly.
Figure 24:
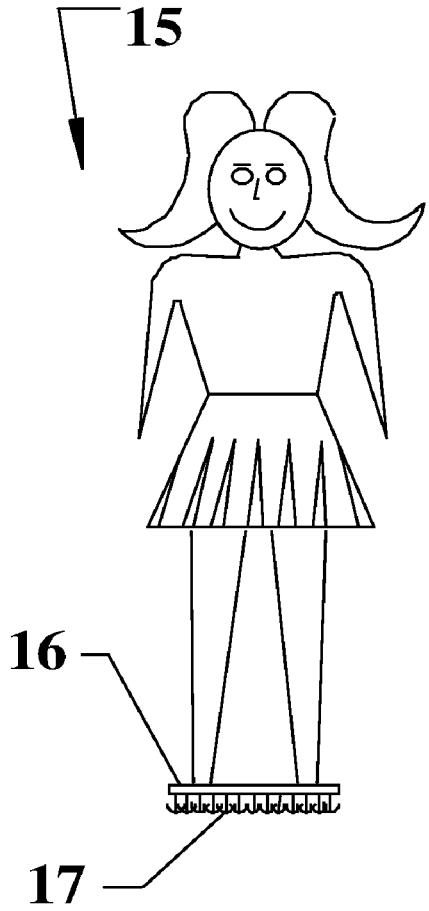
FIG. 24 is a frontal elevation view depicting a cheerleader action-figure.

FIGS. 22, 23 and 24 are elevation views of a poseable cheerleader FIG. 15 comprising a figure base plate 16 and an underside surface of hook-type fastener material 17 such as the hook material found in "Velcro Hook and Loop". The "shoes" of a cheerleader FIG. 15 are attached to a top surface of base plate 16. It is suggested that base plate 16, such as a solid washer, be appropriately weighted in order for a launched and propelled FIG. 15 to "flip over" gymnastically-like one or more times simulating airborne cheerleading tumbling routines. Hook material 17 helps and allows a cheerleader FIG. 15 to successfully land and remain upright because hook material 17 connectively interlocks on contact with corresponding said loop-type fastener materials found atop said landing mats and said landing props. The design characteristics of said hook-type and loop-type materials used in the present invention should match those as manufactured by "Velcro". A plurality of FIG. 15 will be required and will match game piece 12 in corresponding matching color and quantity. Cheerleader FIG. 15 shall be constructed and detailed so as to appear as actual smiling female competitive cheerleaders, anatomically correct and dressed and outfitted accordingly. FIG. 15 shall be constructed so as to allow players to manually configure said figure into life-like poses and positions. It is suggested that said cheerleader figure have the capability of: head rotation/movement; shoulder, elbow and wrist rotation/movement; waist and hip rotation/movement; and knee bending/movement. FIG. 25 shows a plan view of a cheerleader FIG. 15. Base plate 16 may or may not be visible in plan view depending upon the diameter of said plate used.

Figure 26:
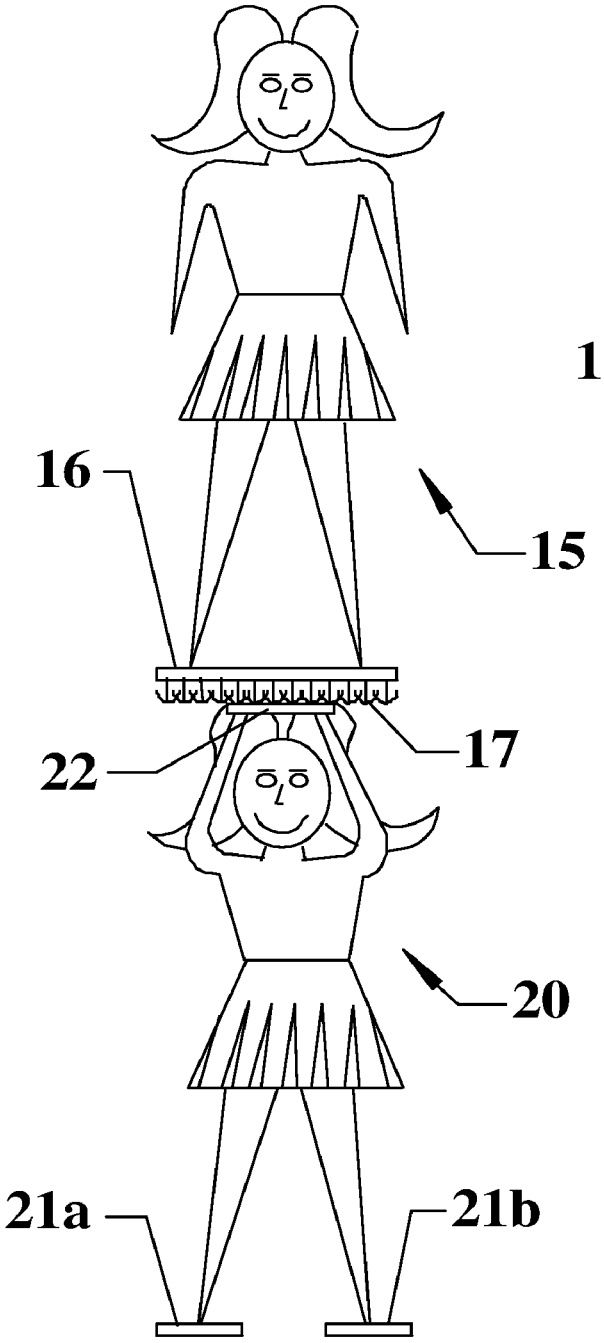
FIG. 26 is a frontal elevation view depicting a cheerleader action-figure performing as a "flyer" balanced atop the Station 1 cheerleader base action-figure.

Elevation view FIG. 26 shows a poseable cheerleader FIG. 15 simulating a "flyer" that has been strategically player positioned and balanced atop a Station 1 non-poseable base cheerleader FIG. 20. Cheerleader FIG. 20 comprises figure base plates 21*a* and 21*b* and a flyer support plate 22. Hook material 17 shall rest and balance atop plate 22. Base plates 21*a* and 21*b* are provided so that cheerleader FIG. 20 may stand upright atop balance platform 115. A singular base plate may be used in lieu of said 21*a* and 21*b*.

Figure 27:
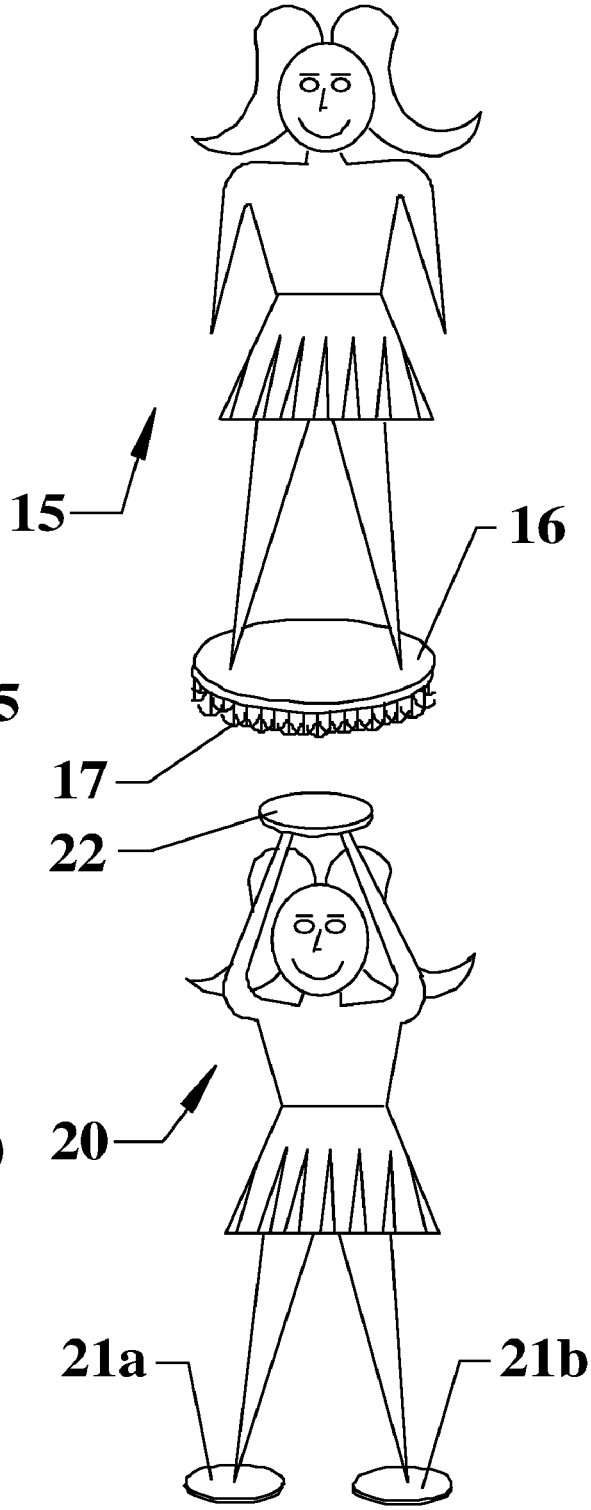
FIG. 27 is a perspective view depicting a cheerleader action-figure performing as a "flyer" prior to being balanced atop the Station 1 cheerleader base action-figure.

Perspective view FIG. 27 shows cheerleader FIGS. 15 and 20 separated prior to player positioning and balancing.

Figure 28:
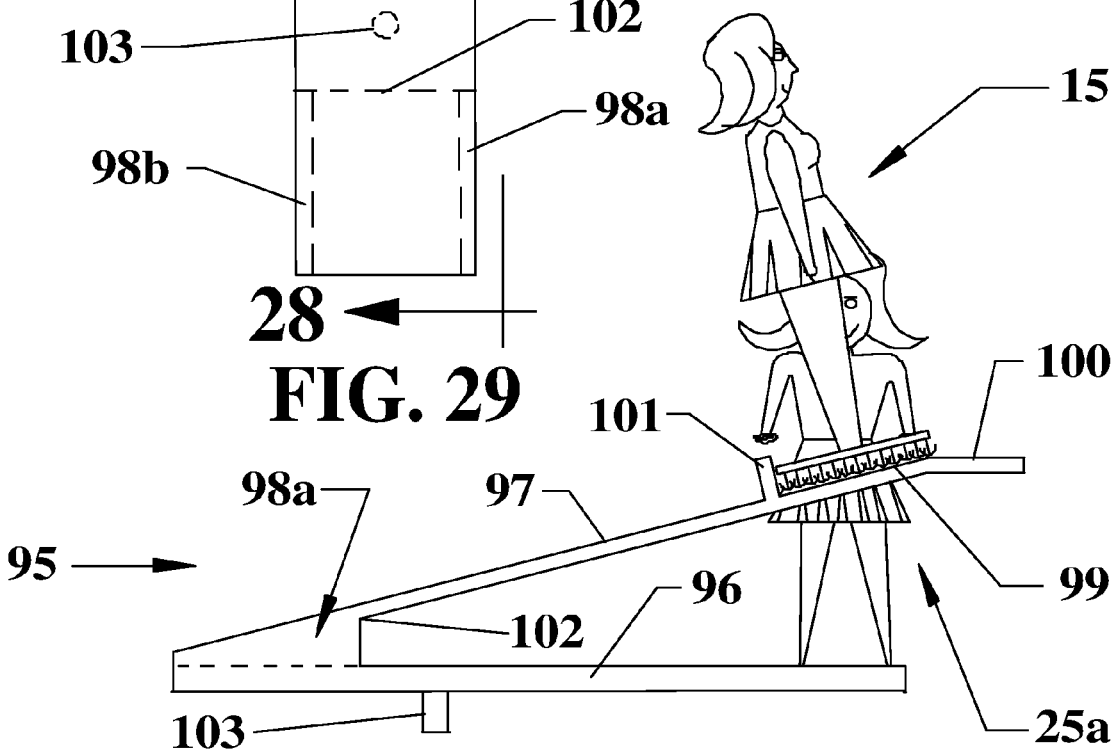
FIG. 28 is a sectional view of FIG. 29 depicting Station 4 launch device.

Sectional view FIG. 28 shows Station 4 with a cheerleader FIG. 15 in launch position atop launch device 95. A stationary non-poseable Station 4 base cheerleader FIG. 25*a* is shown standing next to launch device 95. FIG. 25*a* and FIG. 25*b* (not shown) are simulating opposing base cheerleaders that are both pretending to be supporting the cheerleader "flyer" prior to said "flyer" being "tossed" by said base cheerleaders, toward a landing mat 170 (not shown here) and desirably onto trophy award target icons located atop said mat. All three said cheerleader figures are simulating a "Target Toss" tumbling routine.

Figure 29:
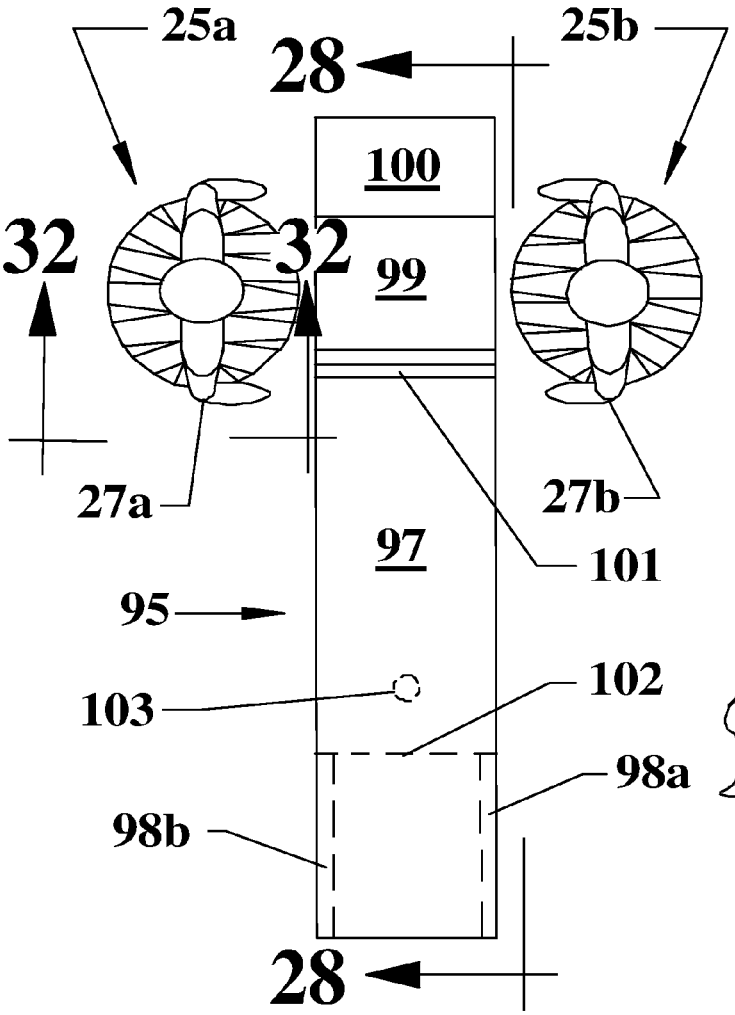
FIG. 29 is a plan view depicting Station 4 launch device.

Plan view FIG. 29 shows Station 4 base cheerleader FIGS. 25*a* and 25*b* with launch device 95 located equidistant between. Cheerleader FIG. 15 is not shown here for clarity.

Figure 32:
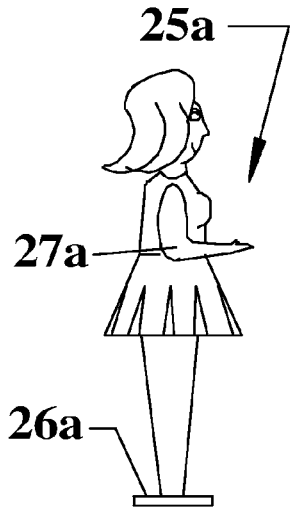
FIG. 32 is a sectional view of FIG. 29 depicting a Station 4 base cheerleader.

Sectional view FIG. 32 shows base cheerleader FIG. 25*a* comprising a figure base plate 26*a* and arm/elbow/hand 27*a*. Both pairs of said figure's arm/elbow/hand 27*a* are permanently positioned as depicted in order to simulate the supporting of the "flyer" in a "target toss". Base cheerleader 25*b* (not shown) also comprises a figure base plate 26*b* and a permanently positioned pair of arm/elbow/hand 27*b*. Base plate 26*a* and base plate 26*b* may be attached to base 96 as to allow simultaneous parallel movement of cheerleader base FIGS. 25*a* and 25*b* with pivoting movement of launch device 95 about dowel 103, as those skilled in the art are quite knowledgeable.

Figure 30:
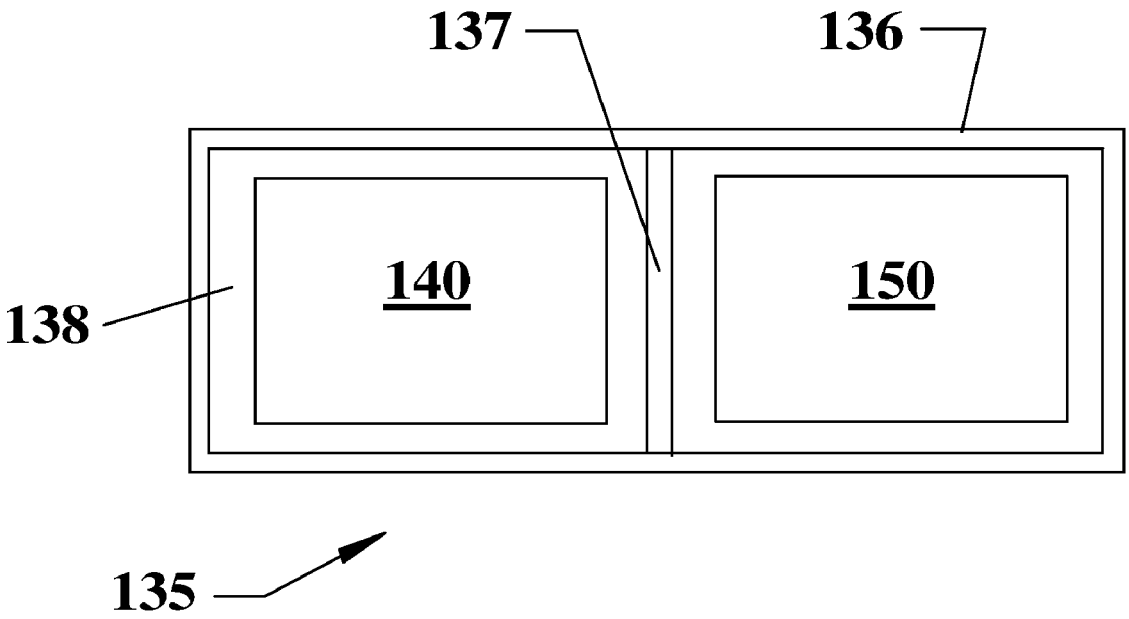
FIG. 30 is a plan view depicting the game cards holder.

FIG. 30 shows a two-deck game card holder 135 that will maintain cards 140 and 150. Holder 135 comprises a peripheral wall 136, a divisional wall 137 and a bottom support 138. No elevation view was deemed necessary as holder 135 will be of shallow construction only allowing for the maintenance of said cards.

Figure 31:
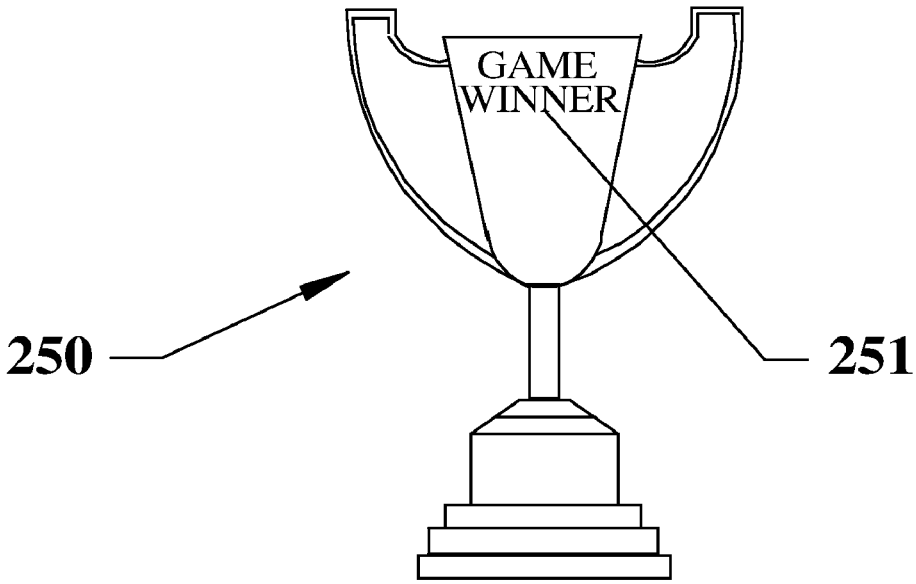
FIG. 31 is an elevation view depicting the game winner trophy.

FIG. 31 shows the player sought-after "Game Winner" trophy 250 that is awarded at the end of a regulation game to the player or team that won the game by collecting the majority plurality of trophy cards. A "Game Winner" trophy label 251 shall appear on trophy 250.

Figure 33:
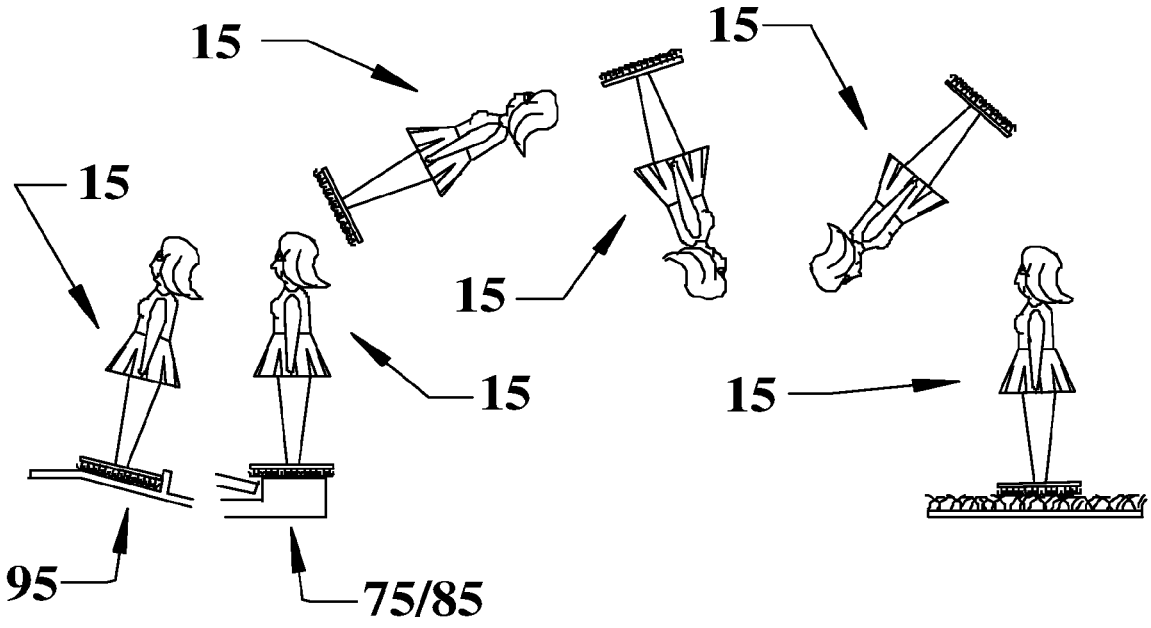
FIG. 33 is an elevation view depicting a cheerleader action-figure being launched and propelled from a launching device and successfully landing on a landing mat.

Elevation "action view" FIG. 33 shows a posed upright cheerleader FIG. 15 being launched from either launch device 95, 75 or 85 and propelled gymnastically-like airborne, "flipping over" while airborne and successfully landing on a said landing surface.

Figure 34:
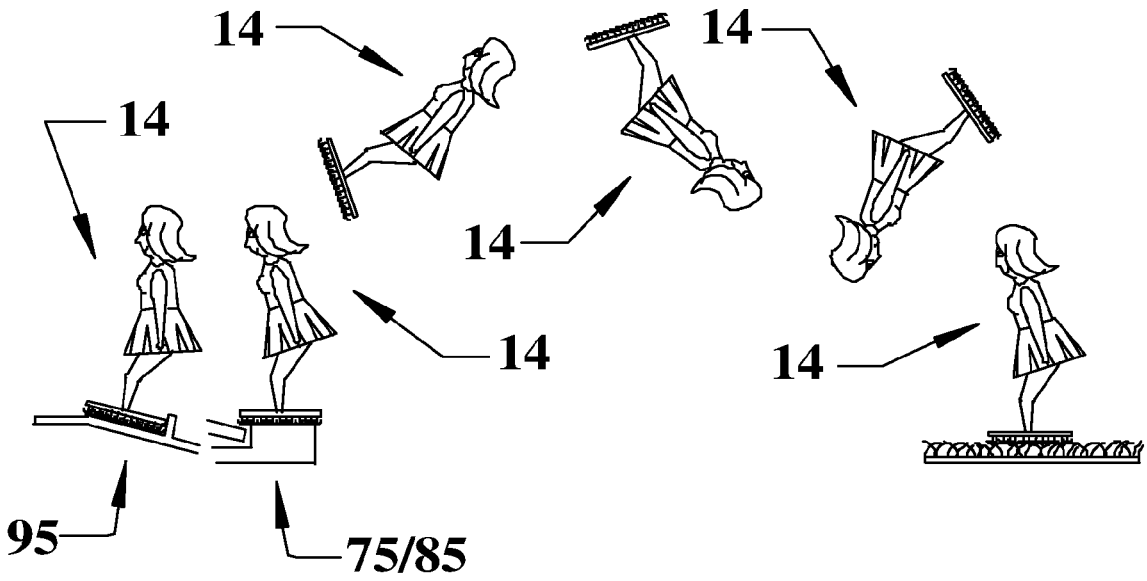
FIG. 34 is an elevation view depicting a cheerleader action-figure posed in a "knees bent" position, and being launched and propelled from a launching device and successfully landing on a landing surface.

Elevation "action view" FIG. 34 shows a posed "knees bent" example cheerleader FIG. 14 being launched from either launch device 95, 75 or 85 and propelled gymnastically-like airborne, "flipping over" while airborne and successfully landing on a said landing surface.

The playing board surface, track spaces, game components, cards, printing, etc. may be of different colors and styles, and include various suitable cheerleading symbology, images, advertising, etc. The board game components may be of any desired material, but preferably of suitable plastic material.

The inventors, having played with a working prototype of the present invention, have evaluated that said launched/propelled cheerleader figures create exciting tumbling routines recording an average 40% success landing rate.

While the invention has been described with reference to certain structure, design and procedure, it should be apparent that embodiment variations might be devised without departing from the principles of this invention.

What is claimed is:

1. A lever and fulcrum operated cheerleading themed simulation board game comprised of:

a plurality of lever and fulcrum machine operating stations capable of launching and propelling human being shaped cheerleading figures to tumble while airborne;

at least one biasing device station for tossing a human being shaped cheerleading figure;

a plurality of poseable human being shaped cheerleading figures, each having a hook and loop fastener means weighted base;

at least one non-poseable human being shaped cheerleading base figure each having a flyer support plate attached to support a poseable cheerleading figure;

a distal launching portion of said lever where said cheerleading figure is initially placed atop making ready for launching and propelling;

a proximal portion of said lever that accepts a downward force from a human finger and then reactively launches and propels said cheerleading figure airborne from said distal launching portion;

a plurality of designated landing zones, which include a plurality of trophy award icons, with said landing zones each having a hook and loop fastener means top surface capable of interlocking with said cheerleading bases, and allowing said cheerleading figures to land successfully upright;

a plurality of landing prop block shapes each having a hook and loop fastener means top surface capable of interlocking with said cheerleading bases, and allowing said cheerleading figures to successfully land upon, comprised of at least one rectangular shaped landing prop block, of at least one cylindrical shaped landing prop block, of at least one rockable semi-circular shaped landing prop block, and of at least one triangularly slanted shaped landing prop block;

a game board;

a divided track defining a plurality of instructional spaces and having a starting point;

a plurality of game pieces for movement along said track from space to space in accordance with numbers selected by lot;

a plurality of instructional game cards; and a plurality of game award cards.

* * * * *